US008152118B2

(12) United States Patent
Melic

(10) Patent No.: US 8,152,118 B2
(45) **Date of Patent: *Apr. 10, 2012**

(54) LOCKING AND LIFTING MECHANISM FOR SAFETY FENCE SUPPORT POST

(76) Inventor: Jonathan Jonny Melic, Stoney Creek (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/392,534

(22) Filed: Feb. 25, 2009

(65) Prior Publication Data

US 2009/0152431 A1 Jun. 18, 2009

Related U.S. Application Data

(63) Continuation of application No. 11/990,091, filed as application No. PCT/CA2006/001309 on Aug. 9, 2006.

(51) Int. Cl.
*E04G 25/00* (2006.01)
*A47F 5/00* (2006.01)

(52) U.S. Cl. ..... 248/200.1; 248/354.1; 248/354.6; 248/161; 248/188.2; 52/126.1; 52/126.6

(58) Field of Classification Search ..... 248/351, 248/354.6, 354.7, 188.5, 200.1, 158, 125.8, 248/161, 188.2; 410/143, 151, 145, 149; 254/12, 15–17, 247, 248, 112; 52/126.6; 403/104, 109.5, 328, 374.5; 74/141.5, 156, 74/167

See application file for complete search history.

(56) References Cited

U.S. PATENT DOCUMENTS

| | | | |
|---|---|---|---|
| 1,516,616 | A | 11/1924 | Meyer |
| 1,639,551 | A | 8/1927 | Booth |
| 2,403,338 | A | 7/1946 | Butler |
| 2,903,227 | A | 9/1959 | Kalb |
| 2,991,040 | A | 7/1961 | Levy |
| 3,143,331 | A | 8/1964 | Corey |
| 3,329,105 | A | 7/1967 | McPherson |
| 3,333,808 | A | 8/1967 | Du Boff |

(Continued)

FOREIGN PATENT DOCUMENTS

| | | |
|---|---|---|
| AU | 603455 | 12/2008 |

(Continued)

OTHER PUBLICATIONS

Photographs of a third party's device dated on or about Nov. 5, 2008.

*Primary Examiner* — Tan Le
(74) *Attorney, Agent, or Firm* — Honigman Miller Schwartz and Cohn LLP

(57) ABSTRACT

A support post for a safety fence assembly. The post includes an outer tube having a floor engaging end for engagement with a floor, an inner tube adapted for sliding telescoping engagement with the outer tube, and a ceiling engaging end for engagement with a ceiling coupled to the inner tube. The post also includes a locking lever assembly with a collar element positioned on the inner tube, and a lever pivotable about a pivot pin for moving the collar element to a tilted configuration in which the collar element is tilted relative to the inner tube for engagement of the collar element with the inner tube. The lever is movable between a release position, in which the collar element is slidably movable longitudinally along the inner tube, and a lock position, in which the collar element is tilted relative to the inner tube and engaged therewith.

18 Claims, 13 Drawing Sheets

U.S. PATENT DOCUMENTS

| | | | | | |
|---|---|---|---|---|---|
| 3,439,898 | A | | 4/1969 | Cleveland et al. | |
| 3,589,682 | A | | 6/1971 | Dickey | |
| 3,635,352 | A | | 1/1972 | Brooks et al. | |
| 3,662,993 | A | | 5/1972 | Lionetto | |
| 3,734,467 | A | | 5/1973 | Weeden | |
| 3,822,850 | A | | 7/1974 | Elias | |
| 3,883,106 | A | | 5/1975 | Simonsen | |
| 3,917,208 | A | | 11/1975 | Magers | |
| 3,920,220 | A | | 11/1975 | Elias | |
| 3,946,992 | A | | 3/1976 | Elias | |
| 3,961,822 | A | | 6/1976 | Daniel | |
| 3,980,278 | A | | 9/1976 | Elias | |
| 4,039,047 | A | | 8/1977 | Larson et al. | |
| 4,433,669 | A | * | 2/1984 | Ishikawa et al. | 123/620 |
| 4,518,141 | A | | 5/1985 | Parkin | |
| 4,761,092 | A | * | 8/1988 | Nakatani | 403/104 |
| 4,928,916 | A | | 5/1990 | Molloy | |
| 5,154,449 | A | * | 10/1992 | Suei-Long | 285/298 |
| 5,228,810 | A | | 7/1993 | Seegmiller | |
| 5,303,832 | A | | 4/1994 | Tu | |
| 5,833,081 | A | | 11/1998 | Smith | |
| 5,924,469 | A | | 7/1999 | Whittemore | |
| 5,988,963 | A | * | 11/1999 | Shiau | 410/151 |
| 6,247,882 | B1 | * | 6/2001 | Huang | 410/151 |
| 6,536,723 | B1 | * | 3/2003 | Nakatani | 248/163.1 |
| 6,554,235 | B1 | | 4/2003 | Fortier | |
| 6,612,533 | B2 | | 9/2003 | Biles et al. | |
| 6,679,482 | B2 | | 1/2004 | Allenbaugh | |
| 6,953,076 | B2 | | 10/2005 | Whittemore | |
| 7,255,312 | B2 | | 8/2007 | Melic | |
| 7,267,310 | B2 | * | 9/2007 | Welch et al. | 248/218.4 |
| 7,273,200 | B2 | | 9/2007 | Funes Gavilan | |
| 7,275,731 | B1 | | 10/2007 | Shinault | |
| 7,290,742 | B2 | * | 11/2007 | Wang | 248/200.1 |
| 7,510,152 | B2 | * | 3/2009 | Melic | 248/200.1 |
| 7,699,276 | B2 | * | 4/2010 | Melic | 248/200.1 |
| 2007/0252054 | A1 | | 11/2007 | Melic | |
| 2007/0257180 | A1 | | 11/2007 | Melic | |

FOREIGN PATENT DOCUMENTS

| | | |
|---|---|---|
| BE | 538792 | 6/1955 |
| CA | 1291356 | 10/1991 |
| CA | 2351905 | 9/2001 |
| CA | 2418165 | 10/2008 |
| DE | 837770 | 5/1952 |
| EP | 05770399.3 | 5/2007 |
| EP | 1921226 | 5/2008 |
| EP | 06775089.3 | 11/2008 |
| FR | 369806 | 1/1907 |
| WO | WO2006/010270 | 2/2006 |
| WO | WO2007/016785 | 2/2007 |

* cited by examiner

LOCKING AND LIFTING MECHANISM FOR SAFETY FENCE SUPPORT POST

This is a continuation of prior application Ser. No. 11/990,091, filed on Aug. 12, 2010, which was the National Stage of International Application No. PCT/CA2006/001309, filed on Aug. 9, 2006.

TECHNICAL FIELD

This invention relates to a support post for use with a fence assembly at a construction site. In particular, the invention relates to a locking and lifting mechanism for securing telescoping inner and outer tubes comprising a support post.

BACKGROUND ART

Safety barriers or fences are used during the construction of high-rise buildings to prevent construction workers from falling from the building and injuring themselves. They are also useful to prevent materials from falling from the building and for catching any flying debris being blown against the barriers and injuring people below. The safety barriers need to be set up and taken down with relative ease since they are temporary and frequently moved from one location to another as the construction progresses. A safety barrier of this type typically comprises a plurality of posts supporting intervening fence panels.

Various types of support posts and fencing assemblies have been designed to try and address this need for a safety barrier. U.S. Pat. No. 3,822,850 discloses a support for a construction fence. The support comprises a telescoping jack post which can be adjusted to fit snuggly between a floor and ceiling. U.S. Pat. No. 3,589,682 discloses another type of telescopic fence column which has a manually operable jacking system and upper and lower pads for contacting the ceiling and floor of a portion of the building. U.S. Pat. No. 3,946,992 discloses another type of construction fence post which comprises a C-shaped bracket which is used to clamp the post to the edge of the floor section. U.S. Pat. No. 3,734,467 describes an upright for a wall partition which has a compression spring that allows for frictional engagement of the upright between floors of a building under construction. U.S. Pat. No. 6,679,482 discloses an improved construction perimeter guide stanchion. An adjustment system allows one to tightly clamp the pair of jaws at the lower end of the stanchion to the edge of a floor slab in an elevated unfinished building.

Although many attempts have been made to design improved safety barrier systems, there remains a need for a system that is easily erected and dismantled and which is self-adjusting, easily packaged safer and tamper-proof. In Applicant's co-pending U.S. patent application Ser. No. 10/901,141, there is provided a support post and safety fence assembly in which the post has a telescoping inner and outer tube and is supported on a threaded internal shaft coupled to a floor engaging end. A ceiling engaging end is preferably formed with claws that have a number of sharp penetrating points for firm engagement with a support surface. Dynamic adjustability of the support post is provided by internal compression springs which also allow the post to be temporarily positioned in an upright position prior to securement.

DISCLOSURE OF INVENTION

In its broad aspect, the invention provides a support post for a safety fence assembly, the post to be positioned between a floor and a ceiling. The post includes an outer tube including a floor engaging end for engagement with the floor, an inner tube adapted for sliding telescoping engagement with the outer tube, and a ceiling engaging end for engagement with the ceiling, coupled to the inner tube. The ceiling engaging end includes a stem slidingly received in the inner tube and a top compression spring captured between the stem and a supporting collar fixed to an interior surface of the inner tube. The post also includes a locking lever assembly for urging the ceiling engaging end against the ceiling and for fixing the position of the inner tube relative to the outer tube. The locking lever assembly includes a collar element positioned on the inner tube and a lever pivotable about a pivot pin for moving the collar element to a tilted configuration in which the collar element is tilted relative to the inner tube for engagement of the collar element with the inner tube. The lever is movable between a release position, in which the collar element is slidably movable longitudinally along the inner tube, and a lock position, in which the collar element is tilted relative to the inner tube and engaged therewith. The lever is adapted, upon the collar element engaging the inner tube as the lever moves from the release position to the lock position, for urging the collar element upwardly, thereby moving the inner tube upwardly relative to the outer tube.

In another aspect, the upward movement of the inner tube relative to the outer tube compresses the top compression spring.

In another of its aspects, upon the lever being moved to the lock position, the inner tube obscures the stem from view, to provide a visual indication of the load being applied to the top compression spring.

In yet another aspect, the collar element is slidably movable along the inner tube to facilitate disengagement of the collar element therefrom.

In another of its aspects, the invention provides a support post for a safety fence assembly. The support post includes a floor engaging end, a first longitudinally extending tube including the floor engaging end, and a second longitudinally extending tube adapted for sliding telescoping engagement with the first tube. The post also includes a ceiling engaging end coupled to the second tube, and a locking lever assembly for fixing the relative position of the first and second tubes. The locking lever assembly includes a collar slidable longitudinally over an inner one of the first and second tubes, and a lever pivotable about a pivot pin between a release position, in which the collar is freely movable on said inner tube, and a lock position, in which the collar is tilted to grip the second tube and the first and second tubes are fixed relative to each other.

BEST MODE FOR CARRYING OUT THE INVENTION

Figure 12:
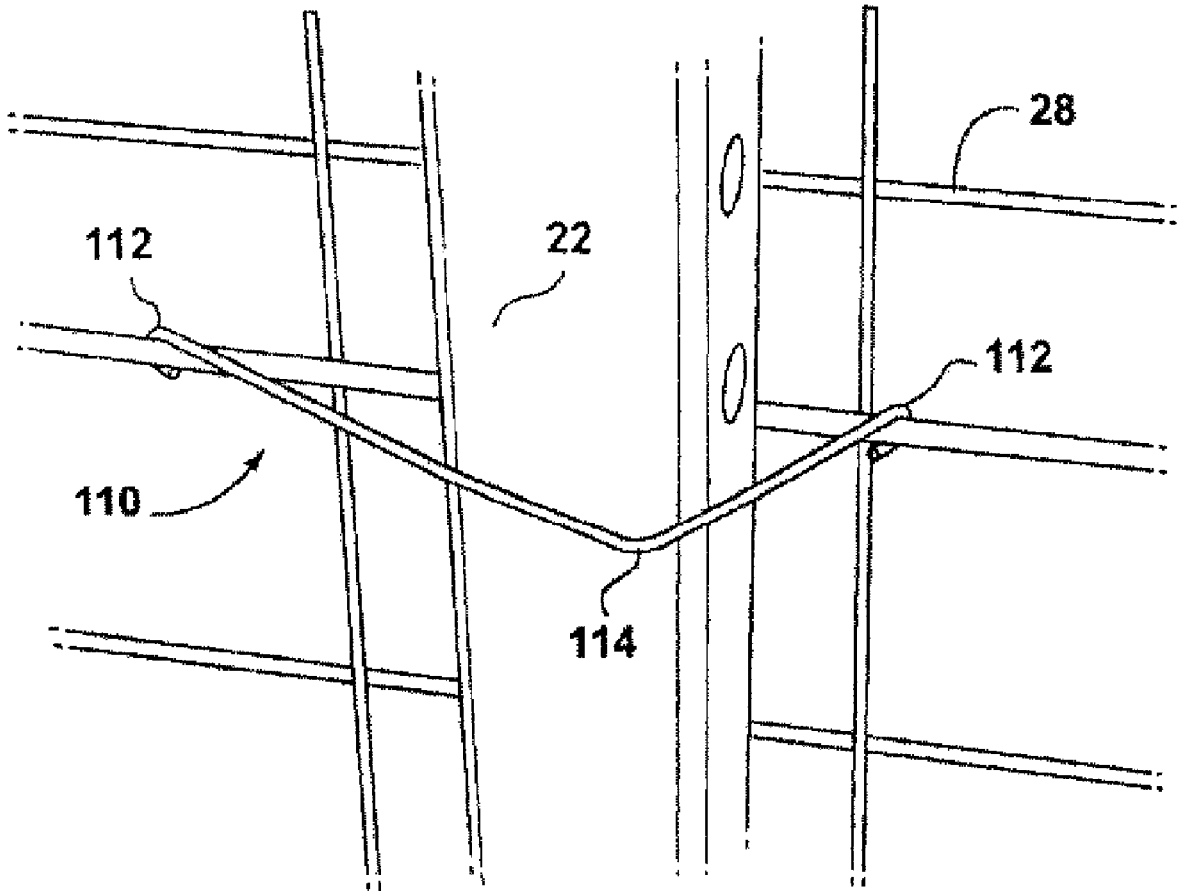
FIG. 12 is a perspective view showing a wire clip for securely coupling a support post to a safety fence panel.

The invention provides a safety fence assembly generally indicated by reference numeral 20 and consisting of a plurality of upright support posts 22 that extend between a supporting surface or floor 24 and a ceiling 26. The posts are normally positioned adjacent to an opening and spaced apart by a distance commensurate with the length of an associated fence panel or barrier 28. The fence panel 28 is normally positioned on the interior side of the associated support post 22 and thus in the view of FIG. 1, the observer would be looking out of a building, the floor 24 and ceiling 26 having been drawn in cross-section. As will be appreciated by those skilled in the art, the safety fence assembly 20 may be used in a number of circumstances according to the needs at the building site. To better secure the support post 22 to the fence panel 28, a wire clip 110 may be used in accordance with the invention. As seen in FIG. 12, the wire clip consists of wire having a diameter of 0.085 (in) suitable for bending into an open hook 112 at opposite ends of a length of 8.4 (in). The wire length has a bend 114 between its ends at an angle of 75° so that the clip may straddle a post 22 as shown. The hooks 112 are adapted to lock into position on wire mesh forming the fence panel 28.

Figure 2B:
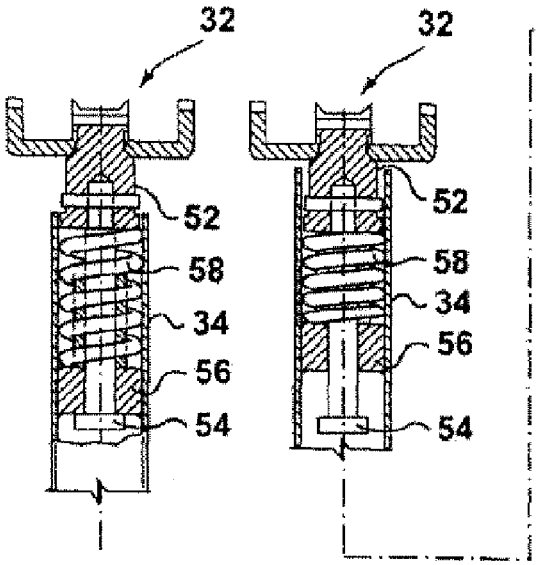
FIG. 2*b* is a cross-sectional view showing a top end of the post of FIG. 2*a* in a relaxed configuration.
Figure 2C:
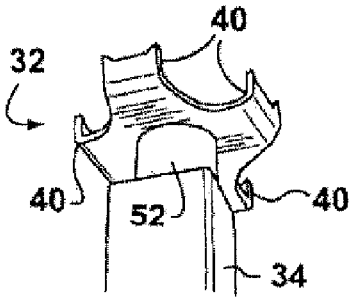
FIG. 2*c* is a perspective view showing the top end of the post of FIG. 2*a;*
Figure 6:
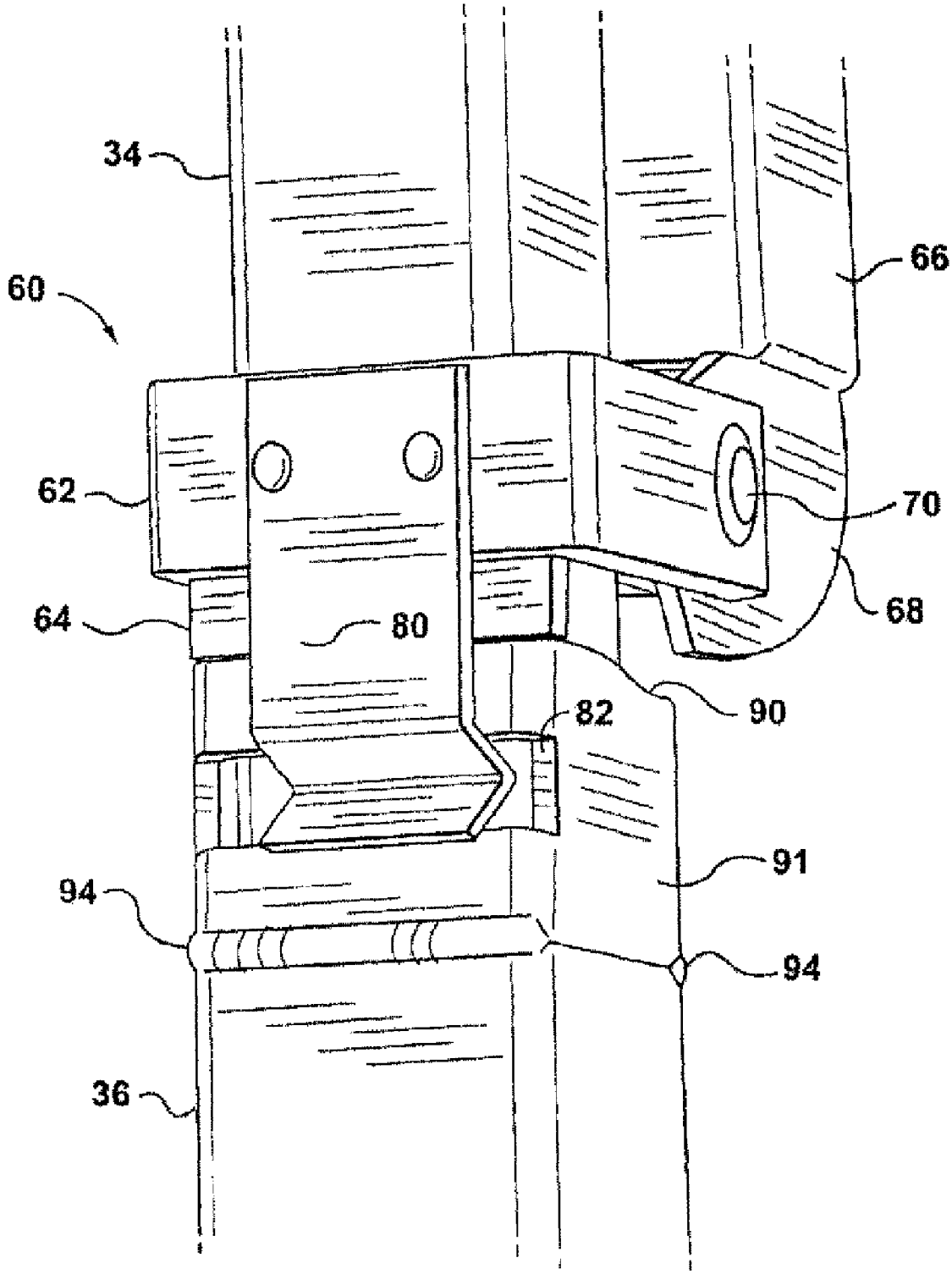
FIG. 6 is a perspective view (drawn to a larger scale) showing the locking lever assembly in a release position.

The construction of the support post 22 is shown in more detail in FIGS. 2*a* through 2*d*. An overall view of the support post 22 is provided in FIG. 3 where it will be observed that the support post has a floor engaging end or foot 30 at one end and a similar ceiling engaging end 32 at the opposite end with a pair of telescoping inner and outer tubes 34, 36 in between. As will be seen from FIG. 6, the cross-section of the inner and outer tubes is square so that rotation of the outer tube 36 will also turn the inner tube 34, as is explained further below. The coupling of the floor engaging end 30 and ceiling engaging end 32 to the support post 22 will be explained in more details with reference to FIGS. 2*a* to 2*d*.

Figure 2D:
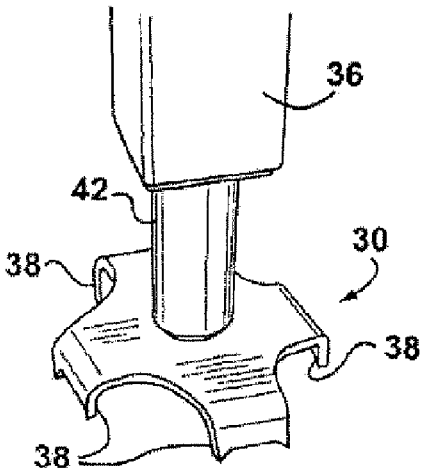
FIG. 2*d* is a perspective view showing a bottom end of the post of FIG. 2*a;*
Figure 3:
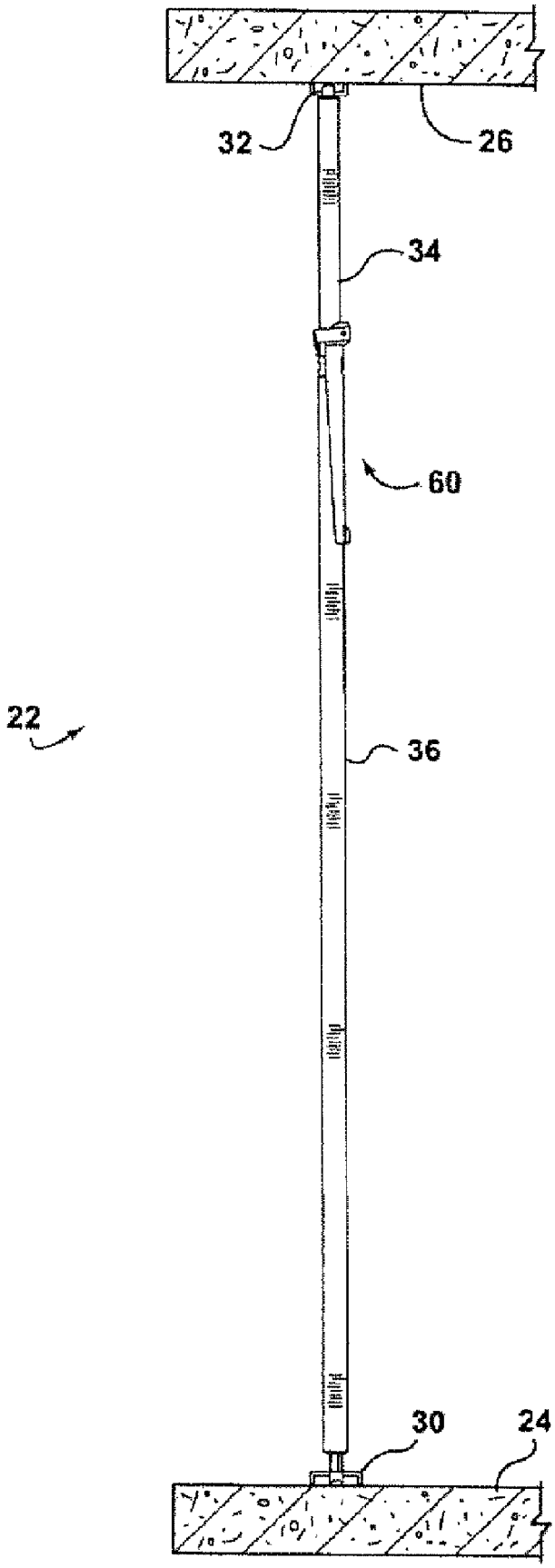
FIG. 3 is a side elevation view showing the post in position between floors of the building under construction.

As will be observed in the detail view of FIG. 2*d*, the foot 30 has a cruciform shape with four feet 38 each having a pair of sharp penetrating claws for firm engagement with a supporting surface. It will be observed that the claws are spaced apart and each has a length that is selected to limit penetration into a supporting surface. This configuration allows safety post 22 to come into firm engagement with the associated floor 24 and to penetrate any surface frost or dust which might otherwise interfere with safe operation of the post. By limiting penetration of the claws into an associated surface, damage to the surface is avoided.

As will observed from FIG. 2*c*, the ceiling engaging end 32 has a similar cruciform configuration with four feet 40 of similar shape. However, it will be observed that the separation between opposing pairs of feet 40 in the ceiling engaging end 32 is smaller than the separation between pairs of feet 38 in the floor engaging end 30. Thus, the floor engaging end 30 has a bigger "footprint" than the ceiling engaging end 32 for increased stability at the operatively lower end of the support post 22 where it needs to support any fence panels 28. Conveniently, the floor engaging end 30 and ceiling engaging end 32 can be nested thereby saving space during shipping.

The floor engaging end 30 is rotatably coupled to a reduced diameter portion of a shaft 42 which extends upwardly in the operative orientation of the support post 22. The shaft 42 is a solid steel bar that has a free end 44 approximately six inches in length that is threaded along its length and concealed from view inside the outer tube 36. The outer tube 36 has an internal nut 46 welded to its interior surface adjacent a lower end thereof and having complementary threads to the threaded end 44 of the shaft 42. The lower extremity of the outer tube 36 has a guide bushing 48 for sliding engagement with the shaft 42 and which closes the lower end of the outer tube 36 to prevent the ingress of dirt into the assembly. A plate 50 (as drawn) or pin is welded to the interior surface of the outer tube 36 above the height of the threaded end 44 of the shaft 42 to stop the telescoping inner tube from falling onto the shaft 42.

Figure 2A:
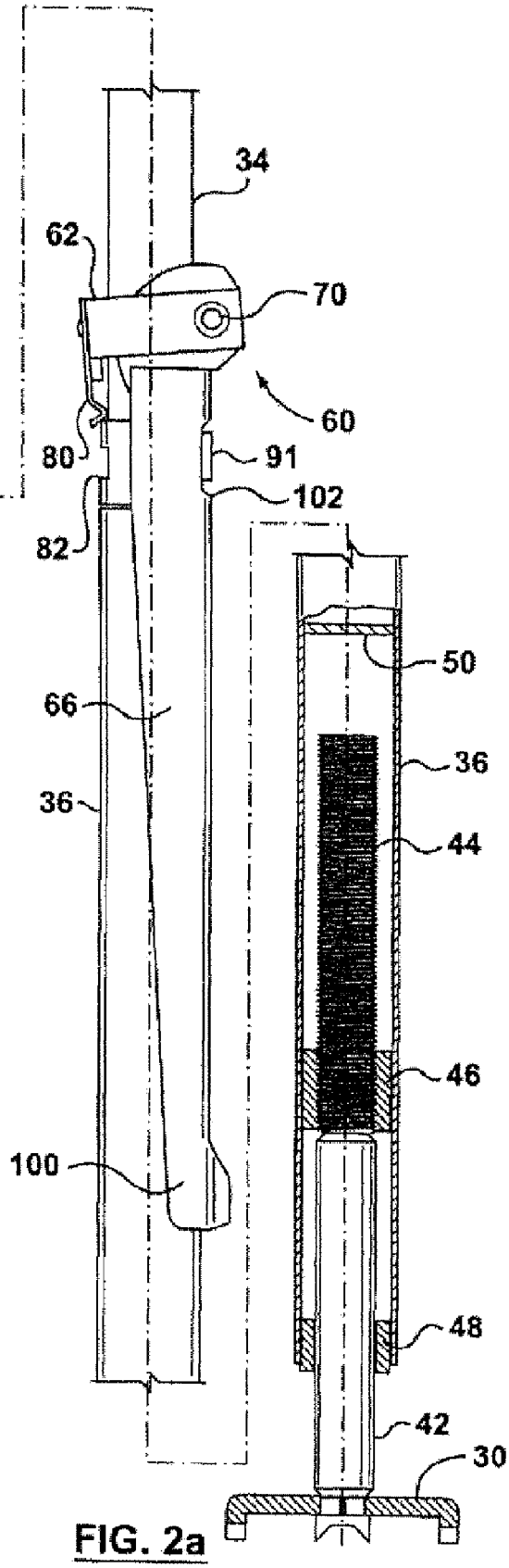
FIG. 2*a* is an assembly view of a post made in accordance with the invention.

The ceiling engaging end 32 is rotatably coupled to a stem 52 which is slidingly received in the operatively upper end of the inner tube 34. The stem 52 carries a longitudinally extending pin 54 which has a head that locates against a collar 56 welded to the interior surface of the inner tube 34. A top compression spring 58 is captured between the supporting collar 56 and the stem 52. Thus, the application of pressure to the ceiling engaging end 32 will cause the stem 52 to penetrate into the inner tube 34 and compress the compression spring 58 as illustrated by FIG. 2*a*. By contrast, FIG. 2*b* shows the ceiling engaging end 32 with the compression spring 58 in a relaxed configuration disengaged from the ceiling.

Figure 4:
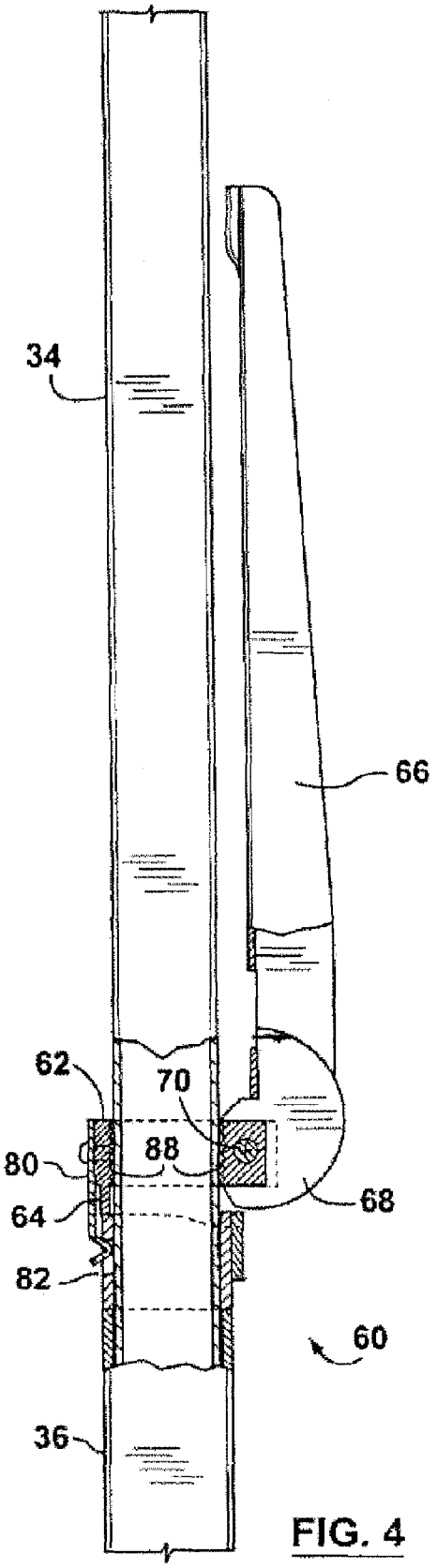
FIG. 4 is a detail partly-sectioned view of a locking lever assembly according to the invention.
Figure 5:
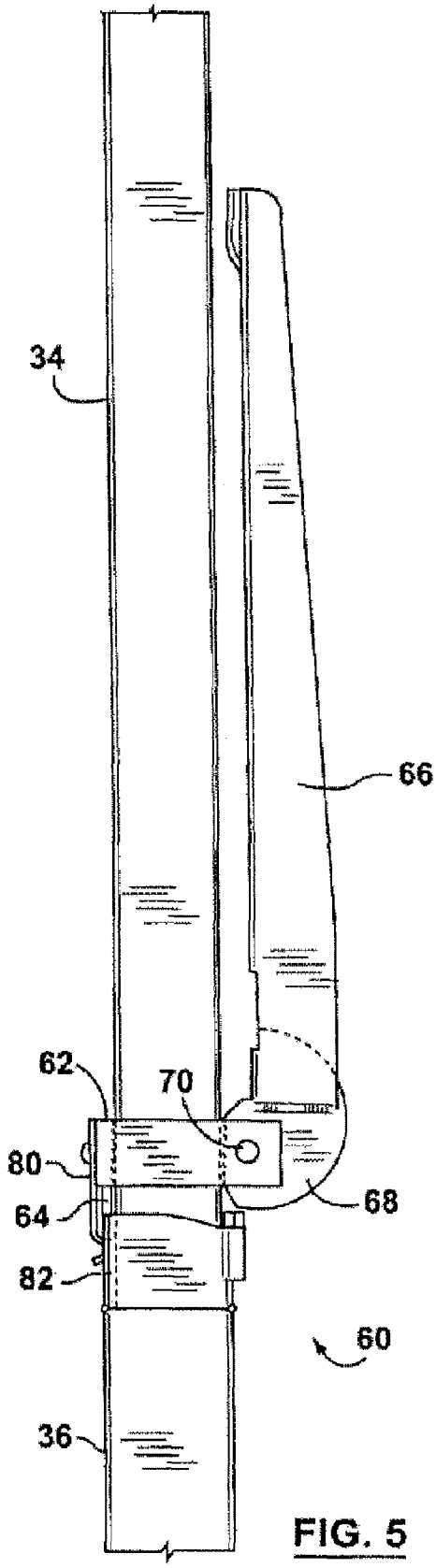
FIG. 5 is a similar view to FIG. 4 with no cross-section.

In accordance with this invention, a locking lever assembly 60 is provided for fixing the relative position of the telescoping inner tube 34 and outer tube 36. The locking lever assembly 60 is illustrated in FIG. 2*a* in its lock position. Its component parts will be described with reference to FIGS. 4 to 6 which are drawn to a larger scale and which show the locking lever assembly 60 in a release position. The operation of the locking lever assembly 60 to bring the assembly from a release position to a lock position will then be described with reference being made to FIGS. 7 to 10.

The locking lever assembly 60 consists of a collar 62 having a square cross-section which is somewhat larger than the cross-section of the inner tube 34 so that the collar 62 can slide longitudinally along the length of the inner tube 34. A downwardly extending lip 64 (as drawn) on one side of the collar 62 is disposed to rest on an upper peripheral edge of the telescoping outer tube 36. The opposite side of the collar 62 has a pivotally mounted lever 66 or handle which is bifurcated at its inner end into a pair of cam portions 68 that receive a pivot pin 70 therebetween. The pivot pin 70 is fixed to opposite sides of the collar 62 and defines a pivot axis 72 (FIG. 8) for rotation of the lever 66 as shown by arrows 74, 76, 78 in FIGS. 7, 9 and 10. A downwardly extending spring clip 80 extends from the collar 62 to rest in a recessed opening 82 formed in the upper portion of the outer tube 36.

Figure 7:
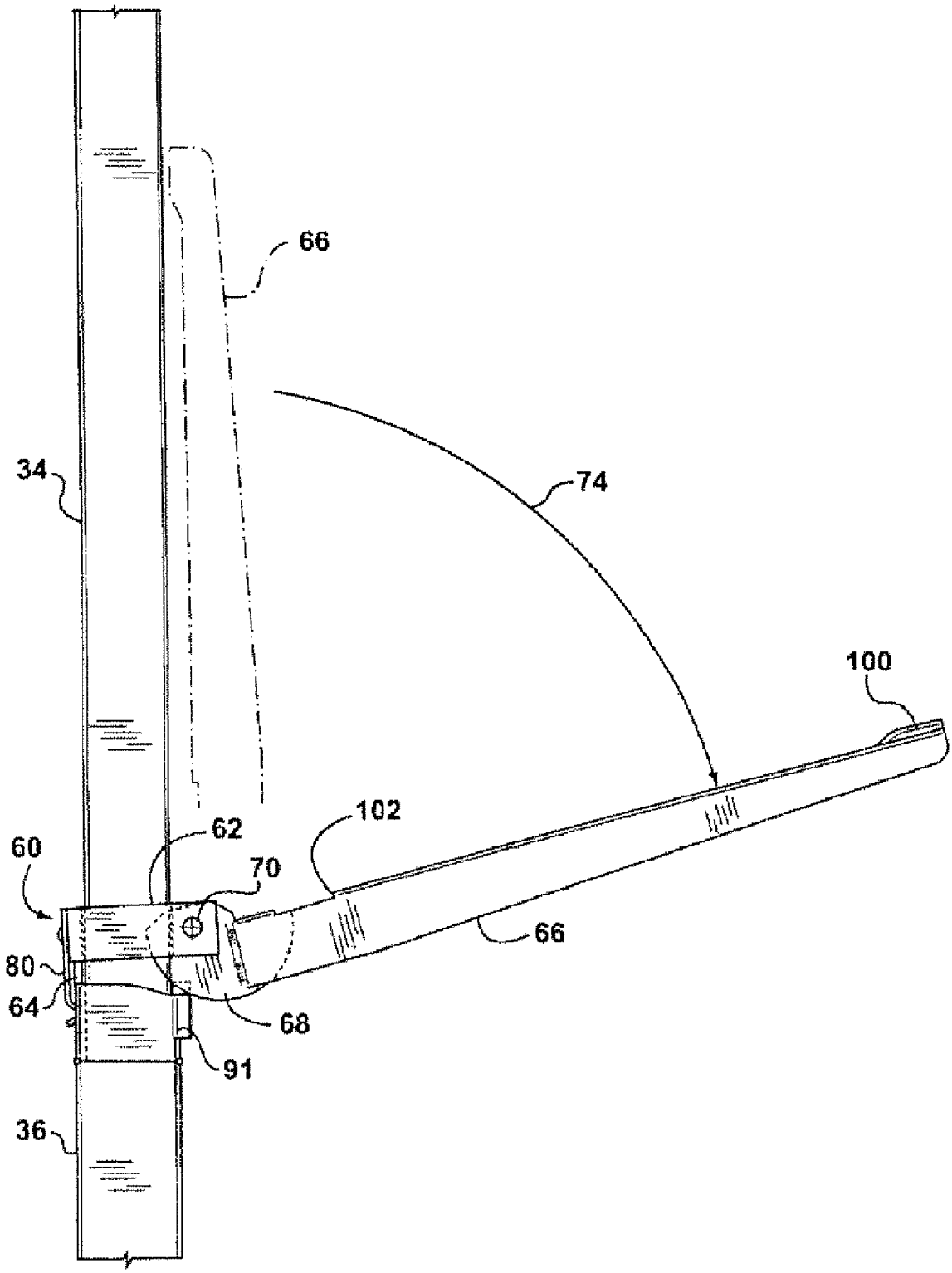
FIGS. 7, 9 and 10 are side elevation views showing the lever of FIG. 4 being lowered to a lock position.
Figure 8:
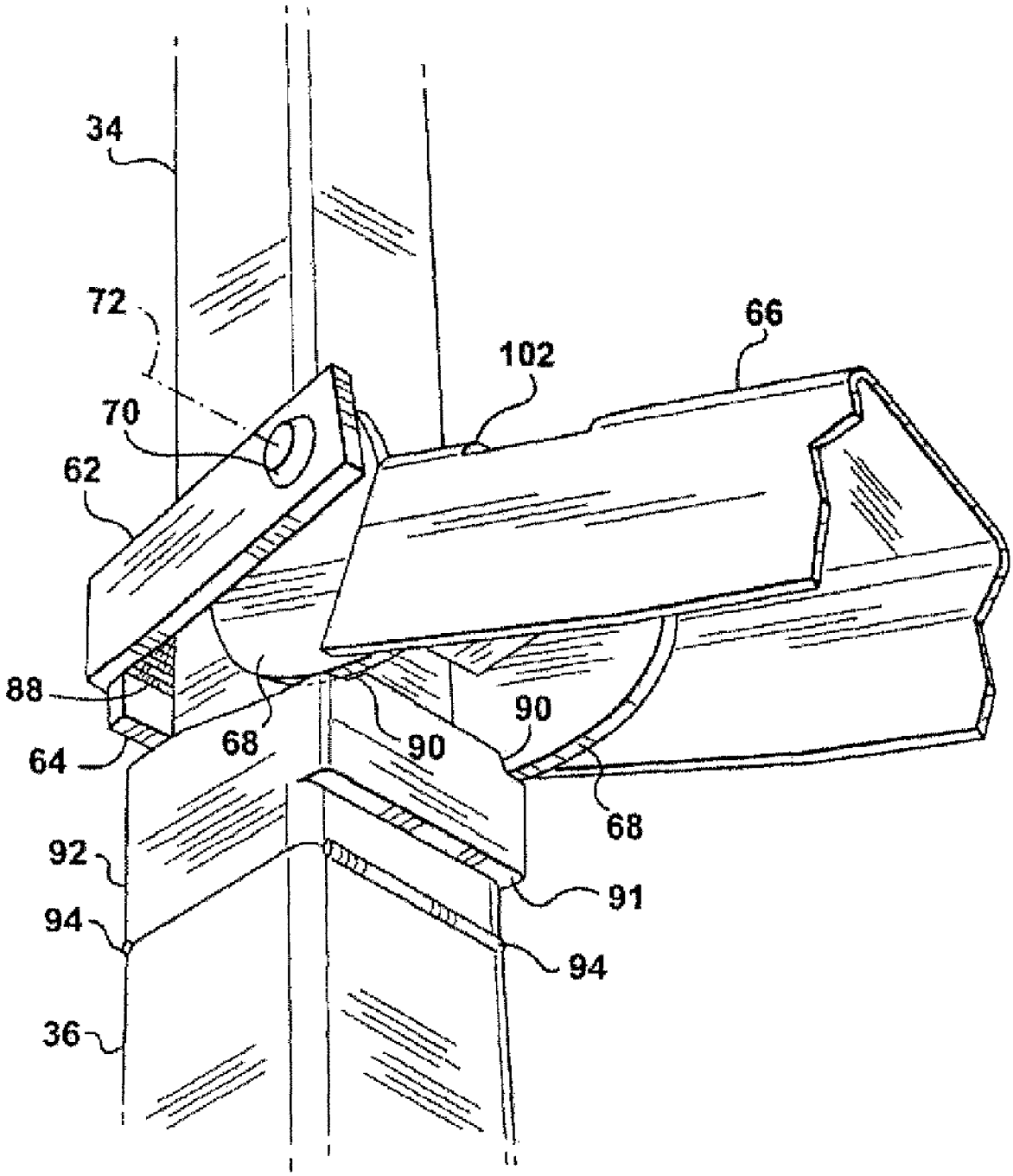
FIG. 8 is a perspective view drawn to a larger scale) showing the locking lever assembly with the lever in a position intermediate between a release position and a lock position.
Figure 9:
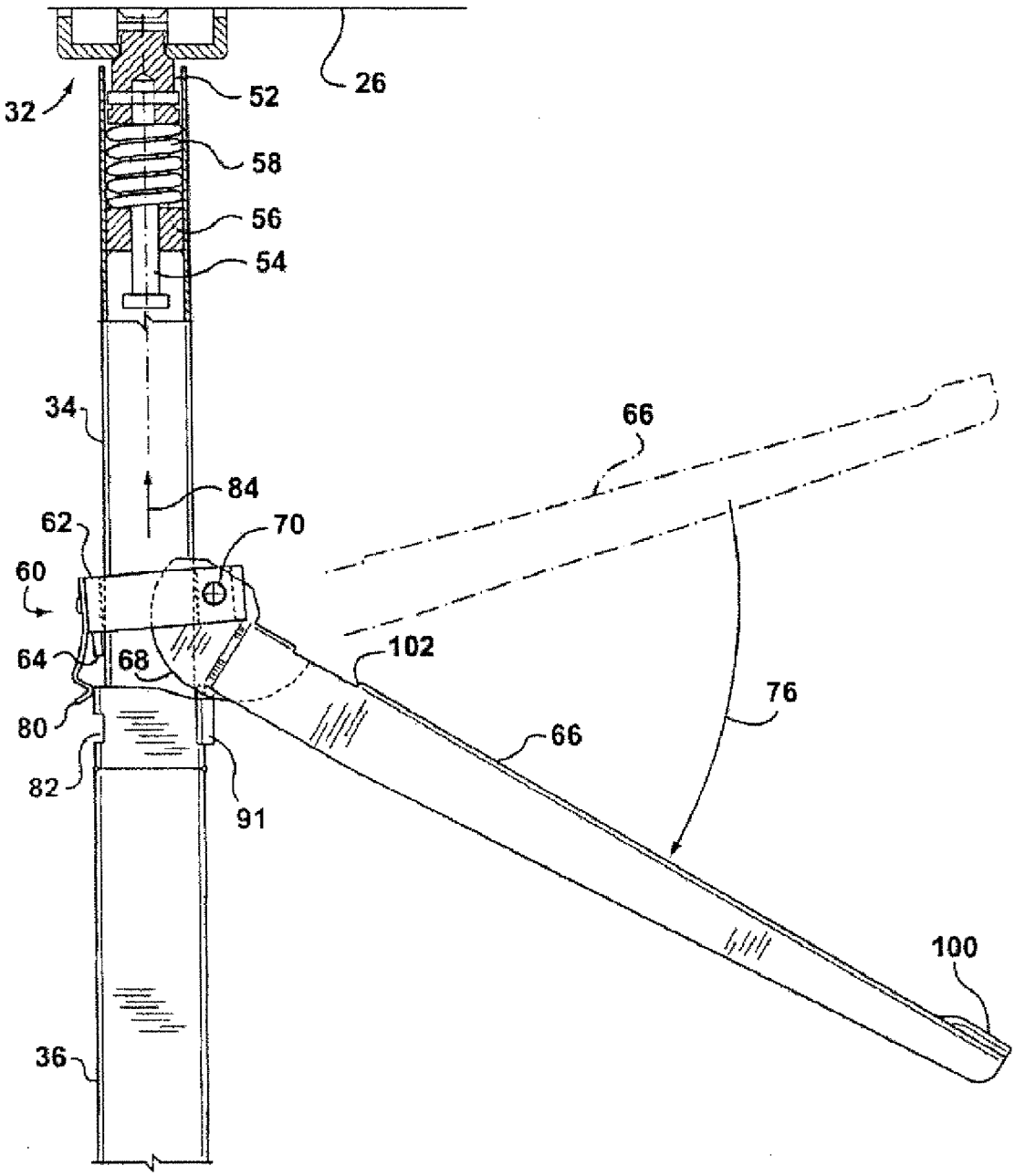

To operate the locking lever assembly 60, the telescoping inner tube 34 and telescoping outer tube 36 are separated from their rest position shown in FIG. 7 in solid line until the ceiling engaging end 32 is brought into engagement with the ceiling 26 as shown in FIG. 9. Meanwhile, the lever 66 is pivoted from its upright release position shown in chain-dotted line in FIG. 7 to its down lock position shown in solid line in FIG. 10. Pivotal movement of the lever 66 is guided by the cam portions 68 which have a curvature and shape adapted to raise the pivot pin 70 so that the collar 62 is raised above the upper peripheral edge of the telescoping outer tube 36 as shown by the separation between the lip 64 and the tube 36 in FIG. 9, and the dislodgement of the spring clip 80 from the recessed opening 82. Upward movement of the collar 62 is accompanied by a tilting movement so that the collar 62 is displaced from its horizontal release position to a transverse position where its inner surfaces engage the outer surface of the telescoping inner tube 34 and simultaneously cause the telescoping inner tube 34 to move upwardly as indicated by arrows 84, 86 shown in FIGS. 9 and 10. Upward movement of the telescoping inner tube 34 further compresses compression spring 58 against the stem 52 of the ceiling engaging end 32. To improve grip between the collar 62 and the telescoping inner tube 34, the inner surface of the collar 62 is roughened and consists of serrations 88 best seen in the cross-sectional view of FIG. 4. The titled configuration of the collar 62 is maintained by spring clip 80 resting against the outer surface of the telescoping inner tube 34.

In order to ensure that the lever 66 remains centered on the post 22 with the cam portions 68 engaging the upper peripheral edge of the telescoping outer tube 36, the telescoping outer tube 36 is made with somewhat thicker walls in the portions which engage the cam portions 68. The telescoping outer tube 36 also has oppositely disposed receiving grooves 90 formed in a thickened wall portion 91 (FIG. 8) which are angled outwardly to bias the cam portions 68 outwardly. Because of repeated wear on the upper peripheral edge of the telescoping outer tube 36, it may be made from a heat treated section 92 which is joined to the remainder of the telescoping outer tube 36 with a weld bead 94. Similarly, the collar 62 and cam portions 68 may be heat treated to prolong durability, maintain gripping in the serrations 88 and generally minimize wear and tear.

In an alternative embodiment of the invention, the cam portions 68 are replaced by straight edges and by a pivot bar that bears against the telescoping outer tube 36 as described with reference to FIGS. 13-16.

Figure 10:
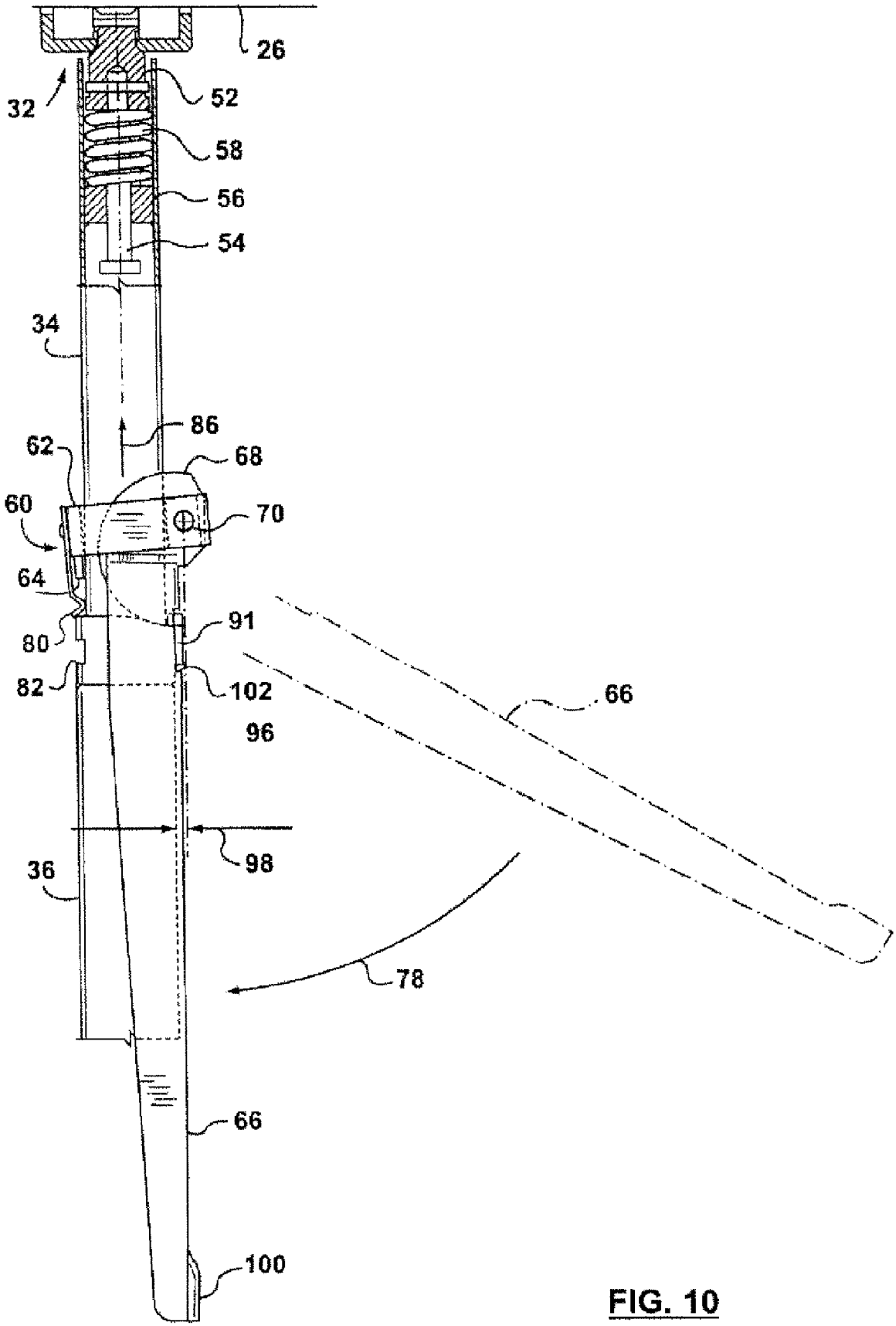

When the lever 66 is brought to rest against the telescoping outer tube 36 in its lock configuration shown by the solid line of FIG. 10, it moves past the center line 96 of the pivot pin 70 as shown by the double arrows 98 and therefore cannot fall away from the post 22 without being positively released. Release of the lever 66 from the post 22 is facilitated by forming a flared portion 100 in the end of the lever 66 remote from the pivot pin 70 which is adapted to receive the claw of a hammer or crowbar (not shown) so as to pry the lever 66 away from the post 22.

An opening 102 is formed in the lever 66 adjacent the cam portions 68 to receive and locate the thickened wall portion 91 of the telescoping outer tube 36.

Figure 11:
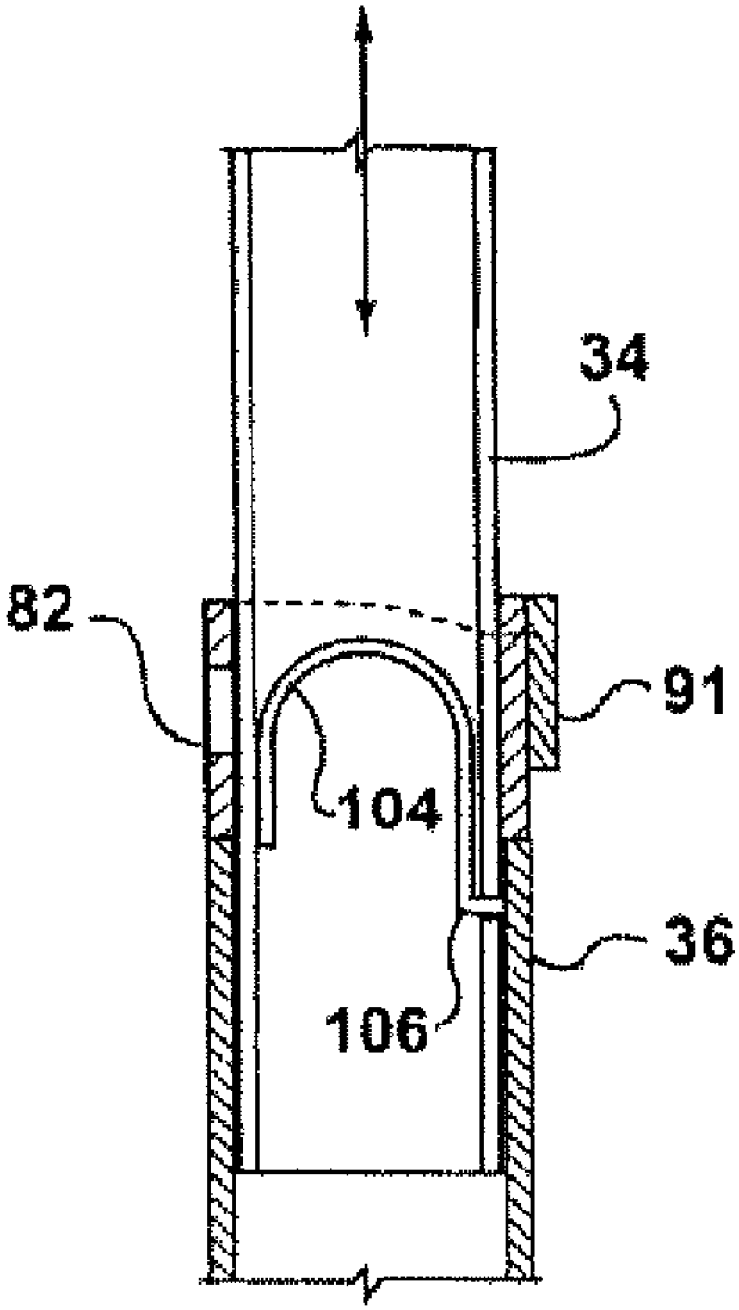
FIG. 11 is a partly sectioned view showing a leaf spring in frictional engagement with a telescoping outer tube.

Relative slipping between the telescoping inner and outer tubes 34, 36 is limited by engagement of the spring clip 80 against the telescoping inner tube 34, the thickened wall portion 91 of the outer tube 36 being received in the opening 102 of the lever 66 and by an inner leaf spring 104 shown in FIG. 11 which is disposed on the interior of telescoping inner tube 34 to frictionally engage the inner wall surface of telescoping outer tube 34 through an opening 106 formed in the telescoping inner tube 34 near the operatively bottom end thereof. The leaf spring 104 has a substantially U-shaped configuration with a lug that extends into the opening 106.

After release of the lever 66, the telescoping inner tube 34 drops a small amount sufficient to shorten the post 22 to a height which clears the separation between the ceiling 26 and the floor 24. The collar 62 is released from its tilted locking configuration by twisting the lever 66 or by hitting the collar 62 with a hammer.

During transportation of the post 22, the telescoping inner and outer tubes 34, 36 are maintained in position by engagement of the spring clip 80 in the receiving opening 82 formed in the telescoping outer tube 36 and by the continued frictional engagement of leaf spring 104 against the interior surface of telescoping outer tube 36.

It will be appreciated that fine adjustments up to an additional six inches may be made to extend the length of the post 22 and maintain optimum pressure on the ceiling engaging end 32.

To secure final placement of the support post 22, the outer tube 36 together with the inner tube 34 may be rotated on the threaded shaft 42. The thread of the threaded end 44 and the nut 46 are formed so that a counterclockwise rotation will bring about an upward vertical movement of the inner and outer tube assembly 34, 36. As pressure is applied to the ceiling engaging end 32, the inner tube 34 moves upwardly relative to the stem 52 thereby obscuring the stem from view. Conveniently the stem 52 may have a bright color applied to it such as a red colored band to provide a visual indication of the load being applied to the top compression spring 58. As observed in FIG. 2*a*, the inner tube 34 completely obscures the stem 52 when the compression spring 58 is fully loaded. It will be appreciated that the top compression spring 58 provides a means to respond in dynamic fashion to any small dimensional changes due to expansion or contraction of the floor and ceiling.

An alternative embodiment of the locking lever assembly will now be described with reference to FIGS. 13-16 and is generally indicated by reference numeral 120. Like numerals are used to identify parts common with the support post 22 described with reference to the preceding figures.

Accordingly, the post assembly has a telescoping inner tube 34 and a telescoping outer tube 36 with a U-shaped collar 62 that can slide longitudinally along the length of the telescoping inner tube 34. An internal surface of the collar 62 has serrations 88 for gripping engagement with the telescoping inner tube and a pivotally mounted lever 66 or handle is coupled to the collar 62 opposite from the serrations 88 at a first pivot pin 70. The handle 66 is bifurcated at its inner end to receive the pivot pin 70 between legs 66*a*, 66*b*. A housing 122 covers the pivot pin 70 to keep the pin 70 clean and to act as a bearing surface for a coil spring 124 as will be described.

Figure 13:
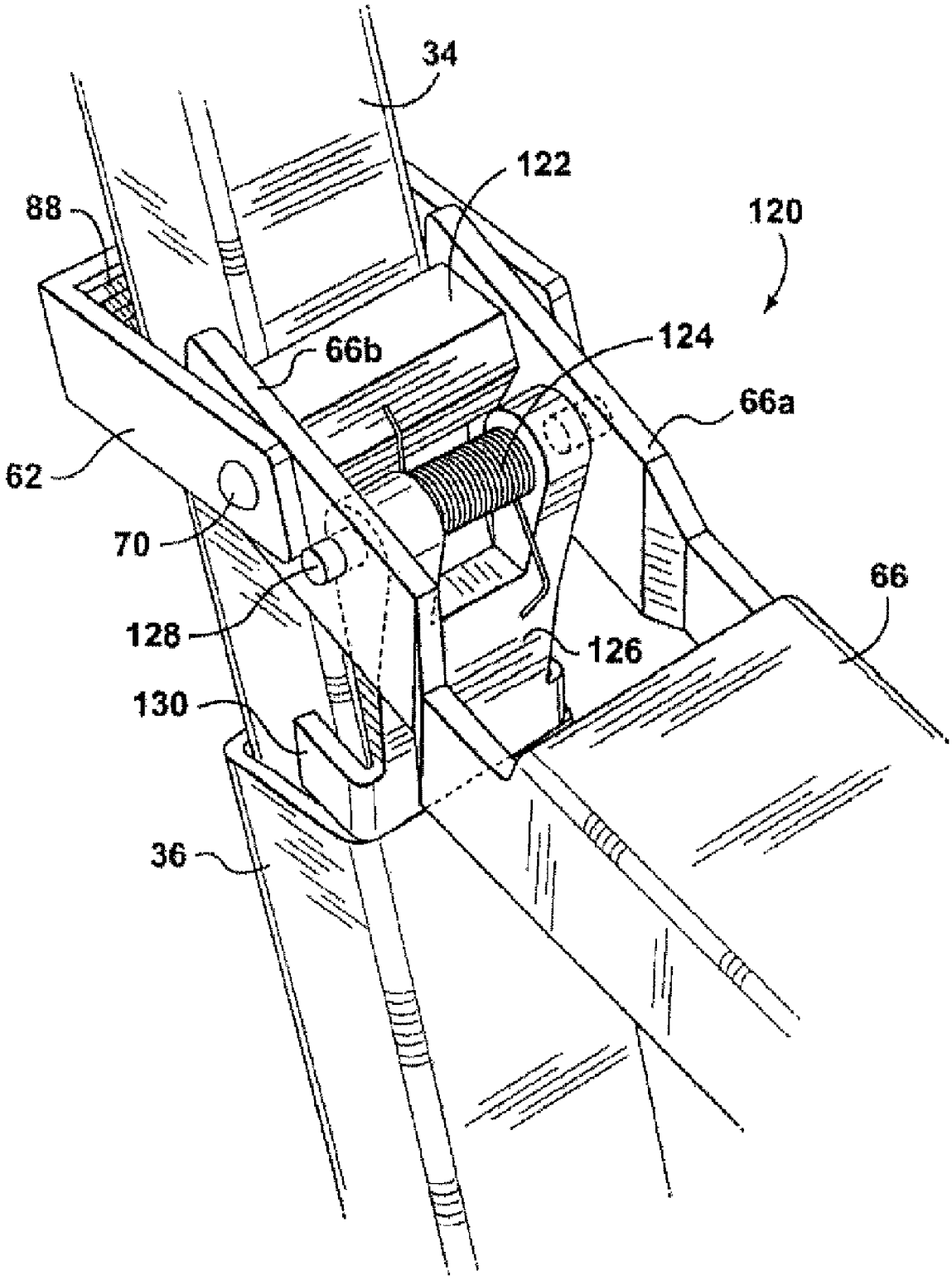
FIG. 13 is a perspective view similar to FIG. 8 of an alternative embodiment of a locking lever assembly in accordance with the invention.

A pivot bar 126 is pivotally mounted between legs 66*a*, 66*b* on a second pivot pin 128 extending therebetween and positioned between the first pivot pin 70 and the lever body 66. The pivot bar 126 is adapted to swing on the second pivot pin 128 to engage the upper peripheral surface of telescoping outer tube 36 with its free end as shown in FIG. 13. Side extensions 130 on opposite sides of the pivot bar 126 are dimensioned to capture the telescoping inner tube 34 therebetween.

Most preferably, the pivot bar 126 is itself bifurcated at the pivot end that receives pivot pin 128 and receives spring coil 124 therebetween with free ends of the spring coil 124 bearing on the housing 122 and on the pivot bar 126 to thereby urge the pivot bar 126 into engagement with the telescoping inner tube 34.

Figure 14:
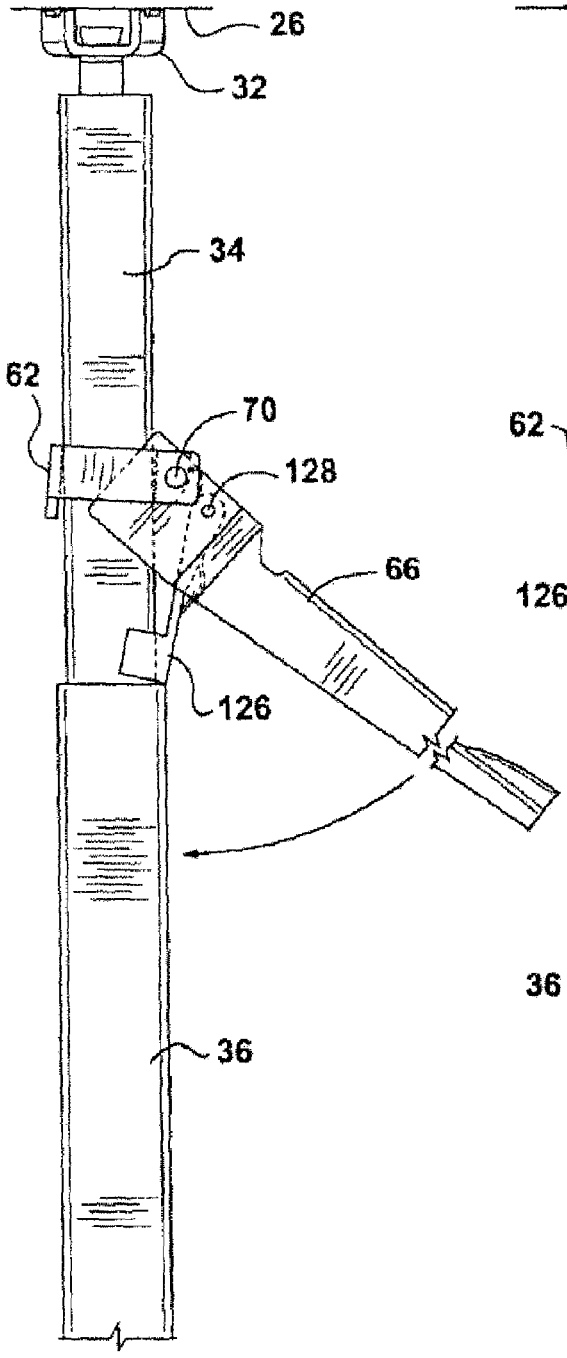
FIG. 14 is a front side elevation view of the lever of FIG. 13 being lowered into a lock position.

The operation of the over-centre locking lever assembly 120 is similar to the assembly 60 previously described. As seen in FIG. 14, the telescoping inner tube 34 and telescoping outer tube 36 are separated until the ceiling engaging end 32 is brought into engagement with the ceiling 26. Meanwhile, the lever 66 is pivoted from its upright release position to its down lock position until the pivot bar 126 engages the upper peripheral surface of the telescoping outer tube 36 and further on to raise the pivot pin 70 and the collar 62. Upward movement of the collar 62 is accompanied by a tilting movement so that the collar 62 is displaced from its horizontal release position to a transverse position where its inner surfaces engage the outer surface of the telescoping inner tube 34 and simultaneously causes the telescoping inner tube 34 to move upwardly as indicated by arrow 132 shown in FIG. 15.

Figure 15:
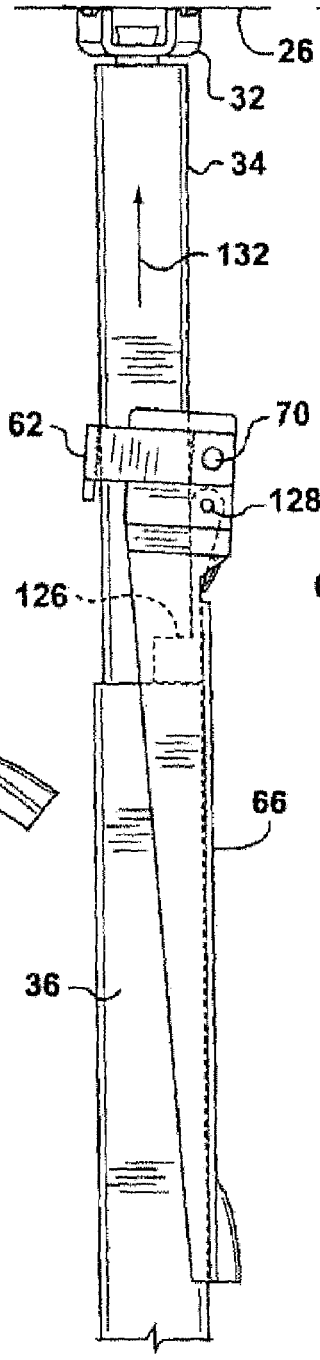
FIG. 15 is a front side elevation view of the lever of FIG. 13 in the lock position.
Figure 16:
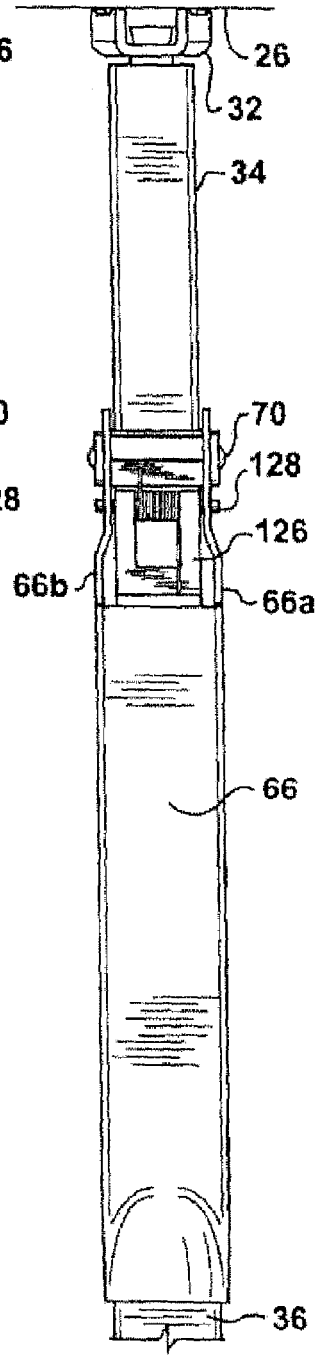
FIG. 16 is lateral side elevation view of the lever of FIG. 13 in the lock position.

When the lever 66 is brought to rest against the telescoping outer tube 36 in its lock configuration shown in FIG. 15 it moves past a center line of the pivot pin 70 and therefore cannot fall away without being positively released.

INDUSTRIAL APPLICABILITY

Once positioned, the support post 22 is extremely stable and secure so that it can successfully withstand pull or push tension tests applied to its mid portion thereby complying with regulations of the applicable health and safety legislation or other legislation.

Figure 1:
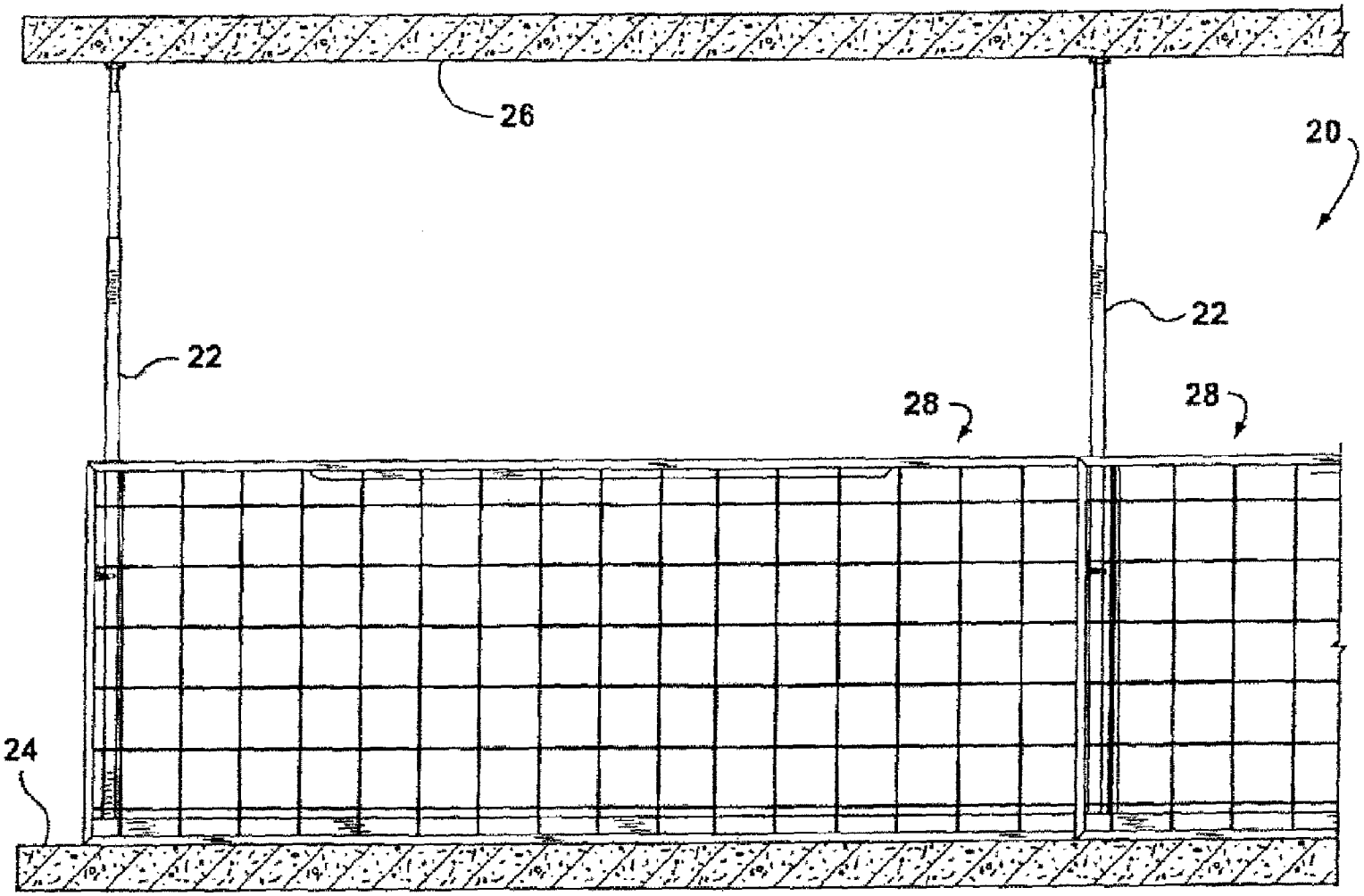
FIG. 1 is a side elevation view of a safety post and fence assembly positioned between two floors of a building under construction.

In use, the support post 22 is erected at selected locations and a plurality are positioned at suitable distances required to support fence panels positioned in overlapping fashion as shown in FIG. 1 in order to form a security barrier.

As will be appreciated by those skilled in the art, several variations may be made to above-described embodiment of the invention within the scope of the appended claims.

The invention claimed is:

1. A support post for a safety fence assembly, the support post to be positioned between a floor and a ceiling, the support post comprising:

an outer tube including a floor engaging end for engagement with the floor;

an inner tube adapted for sliding telescoping engagement with the outer tube;

a ceiling engaging end for engagement with the ceiling coupled to the inner tube, the ceiling engaging end including a stem slidingly received in the inner tube and a top compression spring captured between the stem and a supporting collar fixed to an interior surface of the inner tube;

a locking lever assembly for urging the ceiling engaging end against the ceiling and for fixing a position of the inner tube relative to the outer tube, the locking lever assembly comprising:

a collar element positioned on the inner tube;

a lever pivotable about a pivot pin for moving the collar element to a tilted configuration in which the collar element is tilted relative to the inner tube for engagement of the collar element with the inner tube;

the lever being movable between a release position, in which the collar element is slidably movable longitudinally along the inner tube, and a lock position, in which the collar element is tilted relative to the inner tube and engaged therewith; and the lever being adapted, upon the collar element engaging the inner tube as the lever moves from the release position to the lock position, for urging the collar element upwardly, thereby moving the inner tube upwardly relative to the outer tube, wherein the lever comprises at least one cam surface for engagement with at least one cooperating surface as the lever moves from the release position to the lock position, wherein said at least one cooperating surface is positioned on the outer tube.

2. The support post according to claim 1 in which said upward movement of the inner tube relative to the outer tube compresses the top compression spring.

3. The support post according to claim 2 in which, upon the lever being moved to the lock position, the inner tube obscures the stem from view, to provide a visual indication of the load being applied to the top compression spring.

4. The support post according to claim 1 in which the collar element is supported in the tilted configuration relative to the inner tube by a spring clip resting against the inner tube.

5. The support post according to claim 4 in which the spring clip extends between an upper end secured to the collar element and a lower end positioned in a recessed opening in the outer tube, to at least partially maintain the inner tube and the outer tube in a selected position relative to each other when the lever is in the release position.

6. The support post according to claim 1 in which the collar element is slidably movable along the inner tube to facilitate disengagement of the collar element therefrom.

7. The support post according to claim 1 in which the lever extends between an engagement end for engaging said at least one cooperating surface and an outer end positioned distal to the engagement end, the outer end comprising a flared portion in which a tool is at least partially receivable to facilitate movement of the lever between the lock position and the release position.

8. The support post according to claim 1 in which the outer tube comprises an upper end collar on which said at least one cooperating surface is located.

9. The support post according to claim 8 in which the lever comprises an upper end collar-receiving portion for at least partially receiving the upper end collar of the outer tube to permit an outer surface of the lever to be positioned proximal to the outer tube when the lever is in the lock position.

10. The support post according to claim 1 in which the pivot pin is mounted to a selected side of the collar element.

11. The support surface according to claim 10 in which the collar element comprises an internal surface positioned distal to the selected side of the collar element, the internal surface being adapted for engagement with the inner tube when the selected side is moved upwardly relative to the inner tube.

12. The support surface according to claim 11 in which the internal surface comprises teeth adapted to grip the inner tube.

13. The support post according to claim 1 additionally comprising a leaf spring at least partially disposed in the inner tube and comprising a lug thereof extending through an aperture in the inner tube to frictionally engage the outer tube, to at least partially maintain the inner tube and the outer tube in a preselected position relative to each other.

14. A support post for a safety fence assembly, the support post comprising:

a floor engaging end;

a first longitudinally extending tube comprising the floor engaging end;

a second longitudinally extending tube adapted for sliding telescoping engagement with said first longitudinally extending tube;

a ceiling engaging end coupled to said second longitudinally extending tube;

a locking lever assembly for fixing the relative position of the first longitudinally extending tube and the second longitudinally extending tube, the locking lever assembly comprising:

a collar slidable longitudinally over the second longitudinally extending tube; and a lever pivotable about a pivot pin between a release position, in which the collar is freely movable on the second longitudinally extending tube, and a lock position, in which the collar is tilted to grip the second longitudinally extending tube and the first longitudinally extending tube and the second longitudinally extending tube are fixed relative to each other, wherein the lever is bifurcated at an inner end thereof into a pair of cam portions that receive the pivot pin therebetween, the cam portions being adapted to bear against an upper peripheral edge of an outer one of said first longitudinally extending tube and the second longitudinally extending tube and having a curvature and shape adapted to raise the pivot pin so that the collar is raised above the upper peripheral edge of the first longitudinally extending tube and tilted to grip an outer surface of the second longitudinally extending tube.

15. The support post according to claim 14 in which the collar comprises an inside surface which is serrated to better grip an outer surface of the second longitudinally extending tube.

16. The support post according to claim 14 in which the collar comprises a longitudinally extending lip on one side of the collar opposite from said lever for resting on an upper peripheral edge of an outer one of said first longitudinally extending tube and the second longitudinally extending tube.

17. The support post according to claim 14 in which the upper peripheral edge of an outer one of said first longitudinally extending tube and the second longitudinally extending tube comprises a pair of oppositely disposed grooves shaped to receive and locate said cam portions.

18. The support post according to claim 14 in which the ceiling engaging end comprises a stem slidingly received in the second longitudinally extending tube, and a top compression spring captured between the stem and a supporting collar fixed to an interior surface of the second longitudinally extending tube.

* * * * *